US010273116B2

(12) United States Patent
Kattainen et al.

(10) Patent No.: US 10,273,116 B2
(45) Date of Patent: Apr. 30, 2019

(54) JERK LIMITING IN ELEVATOR RESCUE SYSTEM

(71) Applicant: KONE Corporation, Helsinki (FI)

(72) Inventors: Ari Kattainen, Hyvinkää (FI); Arto Nakari, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 359 days.

(21) Appl. No.: 15/052,685

(22) Filed: Feb. 24, 2016

(65) Prior Publication Data

US 2016/0280507 A1 Sep. 29, 2016

(30) Foreign Application Priority Data

Mar. 23, 2015 (EP) ..... 15160382

(51) Int. Cl.

| | |
|---|---|
| ***B66B 1/08*** | (2006.01) |
| ***B66B 1/32*** | (2006.01) |
| ***B66B 5/02*** | (2006.01) |
| ***B66B 5/04*** | (2006.01) |

(52) U.S. Cl.

CPC ..... *B66B 1/32* (2013.01); *B66B 5/02* (2013.01); *B66B 5/027* (2013.01); *B66B 5/044* (2013.01)

(58) Field of Classification Search

CPC .. B66B 1/32; B66B 5/02; B66B 5/027; B66B 5/044

USPC ..... 187/247, 277, 289, 290, 296, 297, 391, 187/393, 288

See application file for complete search history.

(56) References Cited

U.S. PATENT DOCUMENTS 5,070,290 A * 12/1991 Iwasa ..... B66B 5/02 187/288
7,549,515 B2 * 6/2009 Tegtmeier ..... B66B 5/027 187/288

(Continued)

FOREIGN PATENT DOCUMENTS

EP 1165424 B1 8/2003
EP 1520829 A1 6/2005

(Continued)

*Primary Examiner* — Anthony Salata

(74) *Attorney, Agent, or Firm* — Birch, Stewart, Kolasch & Birch, LLP

(57) ABSTRACT

An elevator rescue system allows an elevator car of an elevator to be moved in an emergency situation. The elevator includes an elevator motor acting on hoisting ropes by which the elevator car is suspended including at least one electro-mechanical brake and an encoder outputting a signal corresponding to its speed. The rescue system includes a back-up power source, a jerk monitoring circuit connected to the encoder and including a memory storing an upper threshold value for the derivative of car acceleration, a brake feed circuit controlled by the jerk monitoring circuit, and a release switch connected to the jerk monitoring circuit and/or to the brake feed circuit. The release switch activates the brake feed circuit to release the brake, and initiate the jerk monitoring circuit to compare the derivative of car acceleration derived from the encoder signal with the stored first upper threshold value, and forwards a control signal to the brake feed circuit to initiate/stop braking depending on the comparison result.

19 Claims, 1 Drawing Sheet

(56) References Cited

U.S. PATENT DOCUMENTS

| | | | | |
|---|---|---|---|---|
| 7,650,968 | B2 * | 1/2010 | Oesterle | B66B 5/021 187/290 |
| 7,681,693 | B2 * | 3/2010 | Tegtmeier | B66B 1/30 187/288 |
| 7,690,483 | B2 * | 4/2010 | Tegtmeier | B66B 5/027 187/290 |
| 8,146,714 | B2 * | 4/2012 | Blasko | B66B 1/30 187/290 |
| 8,207,700 | B2 * | 6/2012 | Syrman | H02P 3/26 187/288 |
| 8,230,978 | B2 * | 7/2012 | Agirman | B66B 5/027 187/290 |
| 8,297,411 | B2 * | 10/2012 | Hashimoto | B66B 1/285 187/288 |
| 8,631,908 | B2 * | 1/2014 | Schroeder-Brumloop | B66B 5/027 187/290 |
| 8,890,448 | B2 * | 11/2014 | Putkinen | B66B 5/02 318/371 |
| 8,960,371 | B2 * | 2/2015 | Schoenauer | B66B 5/027 187/290 |
| 2006/0201752 | A1 | 9/2006 | Helstrom | |
| 2012/0080273 | A1 | 4/2012 | Herkel et al. | |
| 2017/0313551 | A1 * | 11/2017 | Nakari | B66B 5/027 |

FOREIGN PATENT DOCUMENTS

| | | | |
|---|---|---|---|
| EP | 2020395 | A1 | 2/2009 |
| EP | 2168901 | A1 | 3/2010 |

* cited by examiner

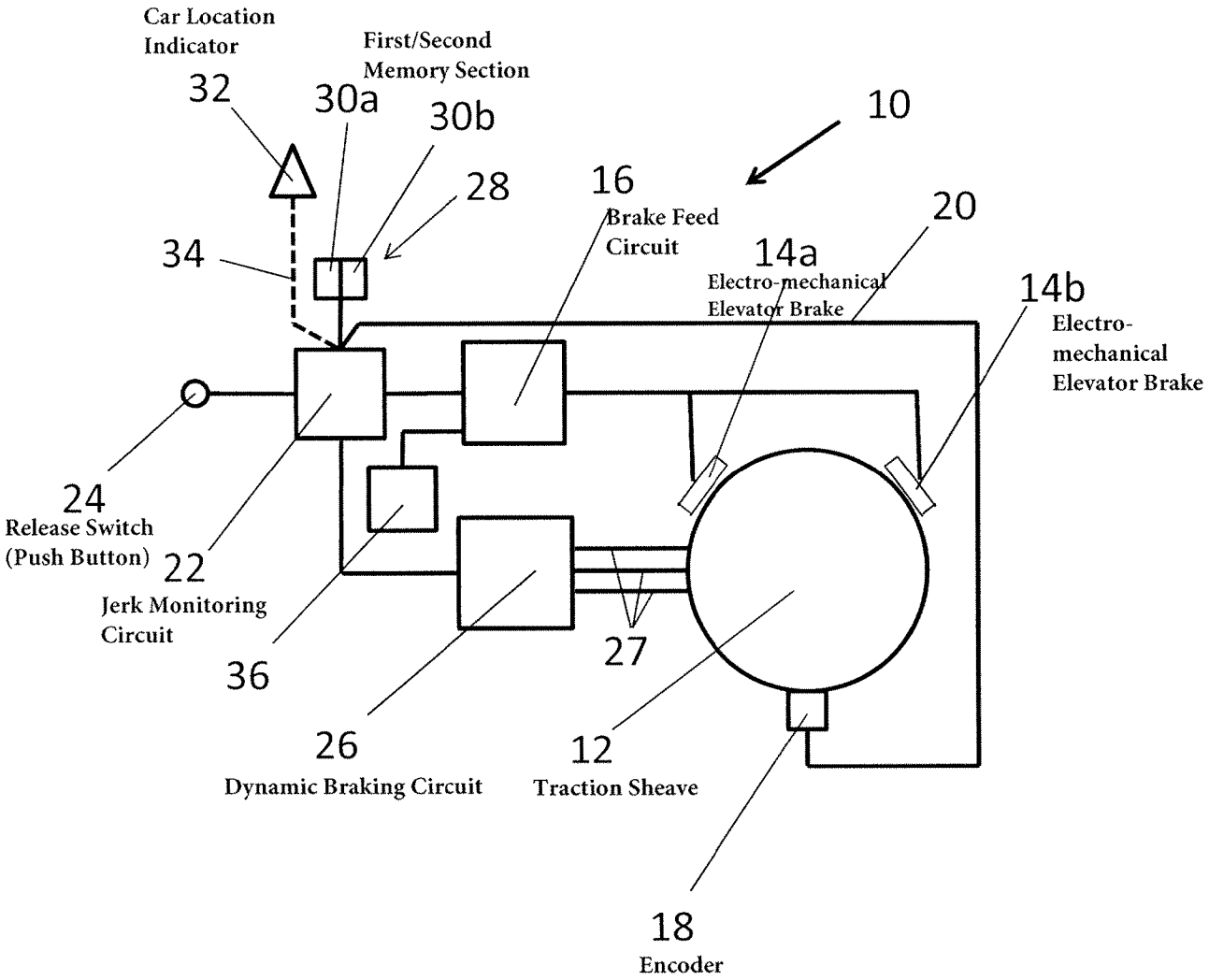
10
20
14b
Electro-mechanical Elevator Brake
14a
Electro-mechanical Elevator Brake
16
Brake Feed Circuit
First/Second Memory Section
30b
28
30a
Car Location Indicator
32
34
24
Release Switch (Push Button)
22
Jerk Monitoring Circuit
36
26
Dynamic Braking Circuit
27
12
Traction Sheave
18
Encoder

JERK LIMITING IN ELEVATOR RESCUE SYSTEM

BACKGROUND OF THE INVENTION

The invention relates to an elevator rescue system particularly intended to free persons trapped in an elevator car. The freeing of trapped persons is necessary when for whatever reasons, e.g. the drop of the electrical network or a safety-related shut-down of the elevator, a moving elevator car comes to a standstill between floors with people trapped in the elevator car.

DESCRIPTION OF THE RELATED ART

Up to now, one known solution is based on a manual operation of the brake of the elevator motor with a brake release lever. With this solution a service technician is able to move the elevator car to the next floor area so that the trapped persons can be freed on the approached floor. The release of the persons requires a skilled service technician which is able to service the brake so that the elevator car drives comfortably with low velocity to the next floor.

The EP 1 165 424 discloses another solution of an elevator safety system where an electric release device is provided backed up by a power source whereby the drive of the elevator car is monitored by an overspeed detection circuit to avoid the drive of the elevator car with overspeed. The problem with this solution is that the acceleration of the elevator car could be quite high depending on the load circumstances of the elevator. In this case, the passengers trapped in the car could face an acceleration or jerk which causes discomfort or even triggers panic.

SUMMARY OF THE INVENTION

It is therefore object of the present invention to provide an elevator safety system which enables a safe and comfortable movement of trapped passengers to the next floor.

The object of the invention is solved with an elevator rescue system and method recited in the appended claims. Preferred embodiments of the invention are the subject-matter of the dependent claims. The inventive content is also described in the description and in the drawings. The inventive content may also consist of several separate inventions, especially if the invention is considered in the light of expressions or implicit subtasks or in view of advantages or set of advantages achieved. In this case, some of the attributes contained in the claims below may be superfluous in respect of separate inventive concepts.

The elevator for which the inventive elevator rescue system is designed includes an elevator motor acting on hoisting ropes by which the elevator car is suspended and/or moved. The elevator motor comprises at least one electro-mechanical brake and an encoder outputting a signal corresponding to the motor speed. The term encoder includes all devices which are able to output a signal dependent on the motor speed.

The inventive rescue system comprises a back-up power source to be able to provide power for all the necessary components and actions in case of an emergency when eventually the mains is power off. The term "mains" describes a mains electricity network which is used as power source for the elevator in normal operation, which is usually a three-phase AC network.

Furthermore, the inventive elevator rescue system comprises a jerk monitoring circuit connected to the encoder and comprising a memory for at least one upper threshold value for the car acceleration and/or its derivation in time. The inventive elevator rescue system furthermore comprises a brake feed circuit which is controlled by the jerk monitoring circuit.

The brake feed circuit provides brake current for the electro-mechanical brakes of the elevator motor and is connected to the back-up power source as power supply. In this connection it may be necessary to give a short explanation of common elevator brakes. Usually, an electro-mechanical elevator brake (hereinafter shortly: brake) comprises a spring means which presses brake pad against a brake surface moving together with the rotor of the elevator motor, usually a rim of the traction sheave or a brake disc connected to the rotor or traction sheave. On the other hand, the brake has an electromagnet which pulls the brake pad away from the brake surface, to release the brake. This means that in case of power off only the spring means act on the brake pads so that the brake pads are pushed by the spring means onto the brake surface as to stop the elevator. Only if energized the brake opens and the brake pads are moved away from the brake surface via the force of the electromagnet counteracting the force of the spring means. Via this base arrangement—which is requested by several safety regulations—it is always ensured that in any case of power off, the traction sheave is stopped as to avoid falling of the elevator car. Accordingly, the brake feed circuit usually either provides the feed voltage to the brake as to open the brake or it cuts the brake current off in which case the brake grips. Usually, for redundancy purposes, two parallel brakes are required to meet safety standards.

The elevator rescue system furthermore comprises at least one release switch which is connected to the jerk monitoring circuit and/or to the brake feed circuit. The release switch is preferably a push button which can easily be operated even by unskilled persons. The invention works as follows. When the release switch is activated, the brake feed circuit is controlled to forward current from the back-up power source to the brakes as to release them. At the same time, the jerk monitoring circuit starts its operation whereby it monitors the acceleration of the motor its derivation in time by comparing it with at least one corresponding stored upper threshold value so that when the acceleration and/or its derivation exceeds said threshold value, the jerk monitoring circuit shuts down the brake feed circuit so that the brake starts braking again. The control signal given by the jerk monitoring circuit to the brake feed circuit therefore ensures that the elevator car is moved within an allowed range of acceleration (or derivation thereof). It is even possible to use the acceleration as well as the derivation thereof for the regulation of the brakes so that it can be ensured that neither the acceleration is too high and nor the increase of the acceleration is too high, which both may lead to subjective uncomfortable acceleration feelings with the trapped passengers possibly resulting in panic, considering the circumstance of being trapped. Via this measure it is ensured that the trapped people never face an uncomfortable acceleration or jerk (jerk=derivation of the acceleration in time). This measure therefore essentially enhances the subjective safety feeling of the trapped passengers and avoids any triggering of panic or fear under the trapped passengers.

Preferably the jerk monitoring unit comprises a delay circuit delaying the reactivation of the brake after brake release. Via this measure the brake can be reactivated only a certain time span after it has been previously released to avoid rattling of the brake.

Preferably, the inventive system comprises at least one car location indicator. This car location indicator could be in a simple realization of the invention be realized as a lamp which is lighted when the elevator car enters a floor region which allows the trapped passengers to be set free. In case the location indicator lights up the moving of the elevator car can be stopped manually by releasing the release switch. In an automatic solution, the car location indicator could also be realized as a signal giving means which is connected to the jerk monitoring circuit or to the brake feed circuit, which signal giving means signals the end of the rescue ride and initiates the jerk monitoring unit and/or the brake feed circuit to stop the car movement, i.e. to stop forwarding current to the electro-mechanical brakes of the elevator. Thus, with this embodiment of the location indicator the rescue system automatically stops when the car when it enters the floor area which allows the rescuing of the trapped passengers. In this case the release switch has only to be pushed once, to start the rescue operation. All further movements of the car are handled by the jerk monitoring unit itself.

Preferably, the brake feed circuit comprises a DC/DC voltage converter which is connected to the back-up power source. The DC/DC voltage converter converts the DC voltage of the back-up power which is usually a battery or accumulator, e.g. with 24 V up to the required voltage necessary for the brakes to be released (e.g. 250 V). This is a very simple and efficient realization of a brake feed circuit.

Preferably, the brake feed circuit comprises a semiconductor switch which is connected to an output of the brake feed circuit, whereby a control connector of the semiconductor switch is coupled to the jerk monitoring circuit. The semiconductor switch is preferably a transistor, particularly an IGBT. Via this measure, the brake feed circuit can be controlled by the jerk monitoring circuit in a very simple manner.

When the control signal of the jerk monitoring circuit is low, then no current is fed to the electro-mechanical brakes of the elevator. If the output of the jerk monitoring circuit on the control connector of the semiconductor switch is high, then the semiconductor switch closes feeding the current of the back-up power source, eventually via a DC/DC converter to the brakes so that these are released. Via this measure, the control of the brake feed circuit is realized in a very simple manner and on the other hand this solution ensures that in any case of power off, even of the back-up source, the electro-mechanical brakes stop the elevator motor or traction sheave.

Principally, the release switch could activate the brake feed circuit directly, after which the jerk monitoring unit starts working. Preferably, the release switch activates only the jerk monitoring circuit which is then able to forward a control signal, preferably "high" or 1, to release the brake.

As mentioned above, the control signal of the jerk monitoring circuit is preferably a binary signal whereby preferably "high" or 1 initiates the brake feed circuit to supply current to the electro-mechanical brakes to release them and "low" or 0 initiates the brake feed circuit to stop feeding current to the electro-mechanical brakes to operate them (gripping). This signalling arrangement ensures a maximum of safety in the operation of the elevator rescue system and the signal handling is easy to realize.

Preferably, the car speed of the elevator is monitored by a conventional overspeed governor. The overspeed governor is a mechanical speed control device which activates a safety switch to interrupt current supply to the electro-mechanical brakes at first overspeed level, and further, if car speed still increases, activates a safety gear of the elevator car at a second higher overspeed level. This additionally ensures that an allowed speed range of the elevator car is not exceeded even if the elevator car is run in the emergency mode with mains off.

Preferably, the inventive rescue system and/or the motor control also comprises a dynamic braking circuit which is always active, i.e. also during power off or which is activated at the beginning of a rescue run or after the speed of the elevator motor has reached a certain threshold voltage. The dynamic braking circuit short-circuits the windings of the elevator motor. Dynamic braking may be implemented with specific contactors or by means of solid state switches of an inverter of the motor drive.

The automatic start of the dynamic braking circuit ensures that a resistance is established against the movement of the elevator car which keeps the car velocity in a secure range.

The dynamic braking circuit may controlled by its own control or a part of the motor control which is still active after power-off and which is independent of the elevator rescue system. There are two possibilities for dynamic braking. First: Dynamic braking contactors are used which are always active unless not actively opened. Therefore dynamic braking is always active during rescue operation. Second: The solid state switches of an inverter of the motor drive are used for dynamic braking. In this solution the dynamic braking control gets its operating supply voltage from DC link of the inverter, e.g. when brake is released and motor moves (supplying regenerative energy to inverter DC link). The dynamic braking starts as soon as DC link voltage raises.

By means of the dynamic braking, the acceleration is not only controlled by initiating and stopping braking of the elevator motor but by reducing the car velocity via dynamic braking. Accordingly, the acceleration can be controlled in a much smoother way than with simple on and off switching of the electro-mechanical brakes. In a further embodiment of the invention the dynamic braking circuit can be activated when an integration value of the acceleration exceeds a third threshold value, preferably stored in a memory connected to the jerk monitoring unit. Via this measure it can be ensured that the car velocity doesn't become too high as to avoid activation of the overspeed governor which would lead to a situation where a skilled service technician is necessary to release the elevator car from the gripping state of the safety gear.

Preferably, dynamic braking is activated immediately with the activation of the release switch and is kept active all the time until the end of the rescue drive, i.e. the car reaches a floor area.

If desirable, the dynamic braking circuit may also comprise a braking resistor which may be voluntarily switched into the windings so that two amounts of dynamic braking are obtained, first: dynamic braking with the resistor and second: dynamic braking by short-circuiting the windings, which second case leads to a higher dynamic braking force than the first case. Hereby, three different dynamic braking actions are provided, first: car movement without any dynamic braking, second: car movement slowed down by braking with braking resistor, third: movement of the car while dynamic braking with short-circuiting the motor windings, which leads to the highest deceleration aside of the activation of the brakes. The switching of these three states can be realized by providing a corresponding number of threshold values so that the acceleration or its derivation (jerk) is always kept within the corresponding ranges. Therefore the velocity as well as the acceleration of the car can be easily controlled via the control of the dynamic braking. Therefore the control of the brake feed circuit as well as the dynamic braking circuit via the jerk monitoring circuit are a highly sophisticated solution for a comfortable and safe elevator ride to the next floor to set the passengers free without any feelings of discomfort or panic.

The jerk monitoring unit can also be designated as rescue control circuit as it may also activate the brake on the base of the acceleration and as it may the car velocity via optional dynamic braking of the elevator motor.

Of course, the control of the brake feed circuit via the jerk monitoring circuit preferably also may comprise a lower threshold value which leads the jerk monitoring circuit to control the brake feed circuit to release the brakes. Accordingly, the acceleration range always can be kept between the upper threshold values and the lower threshold values.

Of course, the invention also relates to an elevator or elevator group comprising an elevator rescue system of the aforementioned type. It shall be clear for the skilled person that the above-mentioned embodiments can be combined arbitrarily as long the technical components do not contradict to each other.

The invention further relates to a method for moving an elevator car in an emergency situation. Also in this case, the elevator includes an elevator motor acting on hoisting ropes via which the elevator car is suspended and/or moved. The elevator motor comprises at least one electro-mechanical brake and an encoder outputting a signal corresponding to its speed. The method uses a back-up power source, a brake feed circuit to operate the electro-mechanical brake, and at least one release switch, for example a push button, to initiate a rescue operation. In the method, the operation of the release switch activates the release of the brake to move the elevator car in the direction of a floor according to the imbalance of the elevator, whereby after operating the release switch the acceleration of the elevator car and/or its derivation in time are monitored and the brake is activated every time the acceleration and/or its derivation exceeds an upper threshold value. This method emphasizes the base idea of the present invention to use the monitoring of the actual car acceleration and/or its derivation for switching on and off the electro-mechanical brakes of the elevator motor as to provide a safe and subjective comfortable rescue ride to the next floor.

Preferably, in this method a location indicator is used to monitor the vertical level of the elevator car with respect to the approaching floor level to which the elevator car approaches. The car is then moved in line with the above-mentioned inventive method until the car location indicator indicates the arrival of the elevator car in the approached floor area. It is principally possible that this indicator is a light and the release switch, e.g. push button, has to be pressed until the car location indicator indicates the arrival in the floor area. On the other hand, this measure can be provided automatically in that the car location indicator is a signal giving means which is connected with the jerk monitoring circuit and the jerk monitoring circuit shuts off the control signal to the brake feed circuit as to activate the brake if it gets a signal from the car location indicator. In this case, only a short push of the release switch is necessary to initiate a rescue ride of the elevator car to the next floor without any interaction of the person operating the release switch, e.g. push button. The advantage of this method is that the passengers can be set free by totally unskilled persons, so that no service technicians from the elevator company have to arrive at the building with the trapped passengers. Such unskilled persons can for example be caretakers of the building, even passengers.

Preferably the acceleration of the elevator car and/or its derivation are monitored by comparing it to a first upper threshold value and a first lower threshold value during the rescue drive of the elevator car. In case the upper threshold value is obtained, the brakes are activated and in case the lower threshold value is obtained, the activated brakes are released. Via this measure, the movement of the elevator car is always kept between the upper and lower threshold value of acceleration and/or its derivation.

Preferably, in the method dynamic braking is used so that depending on the actual acceleration values or particularly its derivation in time, the dynamic braking can be started which leads to a reduction of the acceleration of the elevator car. This allows a smooth control of the car acceleration during the car movement. Thus, this solution allows the consideration of the current load condition, whereby in case of a nearly balanced load condition, no dynamic braking is used, whereas in case of an imbalanced load condition, where usually the acceleration rises quite fast, the dynamic braking is initiated as to reduce the acceleration of the elevator car. The control of the dynamic braking can preferably be performed by using the derivation of the acceleration so that the dynamic braking is only used when the acceleration rate, i.e. the increase of acceleration over the time, is too high. The dynamic braking can also controlled by using an integration value of the acceleration so that it is ensured that the car exceeds a certain velocity.

Preferably, the velocity of the elevator car is monitored at least by a conventional overspeed governor to ensure that the elevator car travels within an allowed velocity range.

It is clear for the skilled person that the above embodiments can be arbitrarily combined with each other.

Although the invention is preferably intended for a machine room-less elevator it can also be used in elevators and elevator groups having a machine room.#

The car location indicator can in a simple embodiment be a visual marking, e.g. at the hoisting rope, visible from the release switch, in which case the release switch should be located in a cabinet which allows a view to a corresponding movable part of the elevator, e.g. via a window.

The brake feed circuit, the jerk monitoring circuit and the dynamic braking circuit are functional groups which can be arranged separately or which may be integrated. They can be arranged either separated from or arranged in connection with an elevator control. Each of these components may be provided as a single unit or distributed over several locations, possibly integrated with other functional units.

BRIEF DESCRIPTION OF THE DRAWINGS

The invention is described hereinafter by means of the enclosed drawing. This shows an inventive elevator rescue system with a jerk monitoring circuit and a dynamic braking circuit.

FIG. 1 shows a schematic diagram of an inventive safety system with a jerk monitoring unit, a brake feed circuit and a dynamic braking circuit.

DESCRIPTION OF THE PREFERRED EMBODIMENTS

FIG. 1 shows an inventive elevator rescue system 10 for performing a safe and comfortable rescue drive of an elevator car with trapped passengers to the next floor. The figure shows a traction sheave 12 which drives hoisting ropes on which an elevator car is suspended. The hoisting ropes and the car are not shown in the figure for clarity purposes. In the rim area of the traction sheave 12 two electro-mechanical brakes 14*a*, 14*b* are provided which are controlled by a brake feed circuit 16. The traction sheave 12 is connected with the rotor of an elevator motor, whereby the rotor of the elevator motor and the traction sheave can optionally be integrated in one part, which is the case in the embodiment. In connection with the traction sheave 12 or motor an encoder 18 is arranged which is connected via a first signal line 20 to a jerk monitoring circuit (or rescue control circuit) 22. The jerk monitoring circuit 22 is connected with a release switch 24 which is preferably embodied as a push button and located in a maintenance panel which is accessible either from a floor or from a machine room. The jerk monitoring circuit is furthermore connected to a dynamic braking circuit 26. The output 27 of the dynamic braking circuit is connected to the motor windings. Thus the dynamic braking circuit 26 is able to short-circuit the windings of the elevator motor dependent on a control signal of the jerk monitoring circuit 22. The dynamic braking circuit also may comprise braking resistors so that either by connecting the motor windings via the braking resistors or by short circuiting them two different dynamic deceleration forces can be applied to the motor. The jerk monitoring circuit 22 further comprises a memory 28 having a first memory section 30*a* with a first upper and lower threshold value and a second memory section 30*b* with a second upper and lower threshold section. The rescue system 10 further comprises a car location indicator 32 which is a simple indicating means and/or which is a signal giving means connected via a second signal line 34 to the jerk monitoring circuit 22.

The invention further comprises a back-up power source 36 which is connected with the brake feed circuit 16. The back-up power source is for example an accumulator or a battery. The back-up power source 36 also provides all the components of the inventive elevator rescue system 10 with the required electric power.

The inventive rescue system works as follows: If an emergency situation comes up where people are trapped in an elevator car during a car ride, a comparably unskilled person as for example a housekeeper may open a control cabinet of the elevator and push the release button 24 which starts the jerk monitoring circuit 22. Upon activation the jerk monitoring circuit 22 initiates the brake feed circuit 16 to provide current to the electro-mechanical brakes 14*a*, 14*b* which releases the brakes and initiates the elevator car to start running. The encoder 18 gives a speed signal to the jerk monitoring circuit 22 from which speed signal the jerk monitoring circuit calculates the acceleration and/or its derivation in time. If the acceleration and/or its deviation in time - which means the increase of the acceleration—exceeds a certain first upper threshold value stored in the first section 30*a* of the memory 28, the brake feed circuit 16 is controlled to shut down in which case the electro-mechanical brakes 14*a*, 14*b* start gripping the traction sheave until the actual acceleration value achieves a first lower threshold value, e.g. a certain decrease of the acceleration, in which case the jerk monitoring circuit 22 again activates the brake feed circuit 16 to feed current to the electro-mechanical brakes 14*a*, 14*b* to release them. Via this means the car acceleration is kept below the first threshold value. This car movement monitored by the jerk monitoring circuit 22 ensures that the elevator car approaches the next floor without the acceleration or the rise of the acceleration exceeding a certain threshold value. Therefore, the subjective safety feeling of the trapped passengers is enhanced and the ride of the elevator car to the next floor to free the trapped passengers is more comfortable than in a system where the velocity of the elevator car is monitored.

Furthermore, the jerk monitoring circuit controls a dynamic braking circuit 26 depending on the exceeding of second upper and lower threshold values stored in the second section 30*b* of the memory 28. Preferably, these second threshold values are the derivation of the acceleration so that the jerk monitoring circuit 22 only triggers the dynamic braking circuit 26 to start dynamic braking, i.e. short-circuiting of the motor windings, when the rise of the acceleration, that means the derivation of the acceleration in time, exceeds a certain second upper threshold value. By this means, it can be ensured that in case of an essential imbalance of the elevator system (loaded elevator car minus counterweight), the increase of the acceleration is reduced by starting dynamic braking which then may avoid the triggering of the electro-mechanical brakes 14*a*, 14*b* by the jerk monitoring unit 22. Therefore, the control of the elevator safety travel under use of the braking circuit 26 enables a smoother car drive than in case of a control only via the brakes 14*a,b*. Preferably the first upper and lower threshold values are acceleration values, whereas the second upper and lower threshold values are preferably the derivation values of the acceleration, i.e. the rise or fall of the acceleration over time.

Of course also the integral of acceleration can be used to control dynamic braking. Therefore, the second threshold values in the second memory section 30*b* also may comprise these integral values (velocities) to keep the car velocity within a defined range.

The control of the brake feed circuit 16 via the jerk monitoring circuit 22 is preferably performed in that the brake feed circuit 16 comprises a DC/DC voltage converter converting the DC voltage of the back-up power source 36 (e.g. 24 V) to the DC voltage necessary to activate the electromagnets of the brakes 14*a*, 14*b* (e.g. 250 V). The output of the brake feed circuit 16 is preferably connected with a semiconductor switch and the output of the jerk monitoring circuit 22 preferably is connected with the control gate or connector of the semiconductor switch in the brake feed circuit. The semiconductor switch may be a transistor, preferably an IGBT or MOSFET.

The aforementioned operation of the elevator car towards the next floor can be ensured by holding the release switch 24 pressed until the car location indicator 32 indicates the approach of a floor area in which the trapped passengers can escape. In this case, the release switch has to be manually pushed until the car location indicator 32 lights up. In another embodiment of the invention, the car location indicator 32 is a signal giving device which is connected via a second signal line 34 with to jerk monitoring circuit 22. In this case the car location indicator 24 issues via the second signal line 34 a stop signal to the jerk monitoring unit 22, whereafter the jerk monitoring unit controls the brake feed circuit 16 to stop the car. In this case the car may approach the next floor area automatically. Thus, the release switch, i.e. push button, has only to be pressed once at the beginning and the elevator starts moving automatically whereby the acceleration of the elevator car is monitored by the jerk monitoring circuit 22. After the elevator car reaches a floor area, the car location indicator 32 gives a signal via the second signal line 34 to the jerk monitoring circuit 22 which initiates the jerk monitoring circuit 22 to shut down the brake feed circuit so that the electro-mechanical brakes 14*a*, 14*b* grip the circumference of the traction sheave 12 and stop the elevator car in the approached floor area without any manual interaction of the person who has pushed the release switch. This embodiment has the advantage that the freeing of the passengers can be performed automatically by only pushing the push button 24 once whereafter the jerk monitoring circuit 22 automatically drives the elevator car to the next floor area. This allows totally unskilled persons to free trapped passengers.

The invention is not restricted to the above embodiments but may be varied within the scope of the appended patent claims.

It shall be understood that components mentioned in the invention may be provided once or as several, e.g. distributed parts. Thus, the numbers of brakes may vary between one and four according to the size of the elevator. Furthermore, the jerk monitoring circuit as well as the brake feed circuit as well as the dynamic braking circuit do not necessarily to be separated units but can be integrated as one or several units in another combination or configuration, which may optionally be integrated as a module of an elevator control.

LIST OF REFERENCE NUMBERS

10 elevator safety system
12 traction sheave
14*a,b* electro-mechanical elevator brake
16 brake feed circuit
18 encoder
20 first signal line
22 jerk monitoring circuit
24 release switch (push button)
26 dynamic braking circuit
27 output of dynamic braking circuit
28 memory
30*a,b* first/second memory section
32 car location indicator
34 second signal line
36 back-up power source (battery or accumulator)

The invention claimed is:

1. A rescue system for moving an elevator car of an elevator in an emergency situation, which elevator includes an elevator motor acting on hoisting ropes by which the elevator car is suspended and/or moved, which elevator motor comprises at least one electro-mechanical brake and an encoder outputting a signal corresponding to its speed, which system comprises:

a back-up power source, a jerk monitoring circuit connected to the encoder and comprising a memory for at least one first upper threshold value for the time derivative of the car acceleration, a brake feed circuit which is controlled by the jerk monitoring circuit, at least one release switch which is connected to the jerk monitoring circuit and/or to the brake feed circuit, wherein the operation of the release switch activates the brake feed circuit to release the brake, and initiates the jerk monitoring circuit the jerk monitoring circuit comparing the derivative of the car acceleration derived from the encoder signal with the stored first upper threshold value so that when the derivative of acceleration exceeds the threshold the jerk monitoring circuit supplies, a control signal to the brake feed circuit to initiate/stop braking depending on the comparison result.

2. The system according to claim 1, comprising at least one car location indicator connected to the jerk monitoring circuit or to the brake feed circuit, wherein the control signal produced by the jerk monitoring circuit is supplied to the brake to stop the elevator car when the jerk monitoring circuit or the brake feed circuit receives a signal from the car location indicator, that the car has reached a floor area.

3. The system according to claim 1 or 2, wherein the brake comprises a spring biasing the brake into a gripping state and an electro-magnetic brake release to push the brake into a release state against the force of the spring.

4. The system according to claim 1, wherein the brake feed circuit includes a DC/DC voltage converter, which is connected to the backup power source.

5. The system according to claim 1, wherein the backup-power source is a battery or an accumulator.

6. The system according to claim 1, wherein the brake feed circuit comprises a semiconductor switch, which is connected to an output of the brake feed circuit, whereby the semiconductor switch is coupled to the jerk monitoring circuit.

7. The system according to claim 1, wherein the operation of the release switch activates the jerk monitoring circuit to forward the control signal to the brake feed circuit to release the brake.

8. The system according to claim 1, wherein the control signal is a binary signal which is "high" to release the brake and which is "low" to activate the brake.

9. The system according to claim 1, wherein the power for the operation of the brake feed circuit and/or of the jerk monitoring circuit is obtained from the back-up power source.

10. The system according to claim 1, wherein the car speed of the elevator is monitored by an overspeed governor.

11. The system according to claim 1, comprising a dynamic braking circuit short-circuiting the windings of the elevator motor, which dynamic braking circuit is powered by the back-up power source.

12. The system according to claim 11, wherein the dynamic braking circuit uses an inverter of the elevator motor drive including solid state switches for dynamic braking, whereby a dynamic braking control gets its operating supply voltage from a DC intermediate circuit of the inverter.

13. The elevator including the system according to claim 1.

14. A method of moving an elevator car of an elevator in an emergency situation, which elevator includes an elevator motor acting on hoisting ropes by which the elevator car is suspended and/or moved, which elevator motor comprises at least one electro-mechanical brake and an encoder outputting a signal corresponding to its speed, using a back-up power source, a brake feed circuit to operate the electro-mechanical brake, at least one release switch to initiate a rescue operation, the method comprising:

releasing the brake in response to actuation of the release switch to move the elevator car in the direction of a floor, and monitoring acceleration of the elevator car and activating the brake when the derivative of acceleration exceeds an upper threshold value.

15. The method according to claim 14, further comprising using at least one car location indicator to monitor the level of the elevator car with respect to the floor level to which the elevator car approaches, said method allowing the car is to be moved until the car location indicator indicates arrival of the elevator car in a floor area, where current output to the brake is stopped to halt movement of the elevator car.

16. The method according to claim 14 or 15, wherein after activation of the brake after exceeding the upper threshold value the brake is opened again after the car speed has dropped to a lower threshold value.

17. The method according to claim 14 wherein the operation of the release switch starts the jerk monitoring unit to control dynamic braking of the elevator motor via a dynamic braking circuit.

18. The method according to claim 14 whereby an overspeed governor is used to monitor the elevator car speed.

19. The method according to claim 14 wherein the method is performed by a system a jerk monitoring circuit connected to the encoder and comprising a memory for at least one first upper threshold value for the car acceleration and/or its time derivative; and a brake feed circuit which is controlled by the jerk monitoring circuit;

wherein the release switch is controlled by the jerk monitoring circuit;

wherein the releasing the brake activates the brake feed circuit to release the brake, and initiates the jerk monitoring circuit by comparing the derivative of car acceleration as derived from the encoder signal with the stored first upper threshold value, and forwarding a control signal to the brake feed circuit to initiate/stop braking depending on the comparison result.

* * * * *